US011318511B2

(12) United States Patent
Kotzian et al.

(10) Patent No.: US 11,318,511 B2
(45) Date of Patent: May 3, 2022

(54) WIDTH SETTING ON A FINISHING TRAIN

(71) Applicant: Primetals Technologies Germany GmbH, Erlangen (DE)

(72) Inventors: Daniel Kotzian, Forchheim (DE); Wilfried Tautz, Forchheim (DE)

(73) Assignee: PRIMETALS TECHNOLOGIES GERMANY GMBH

( * ) Notice: Subject to any disclaimer, the term of this patent is extended or adjusted under 35 U.S.C. 154(b) by 185 days.

(21) Appl. No.: 16/783,242

(22) Filed: Feb. 6, 2020

(65) Prior Publication Data

US 2020/0246850 A1 Aug. 6, 2020

Related U.S. Application Data

(62) Division of application No. 15/511,693, filed as application No. PCT/EP2015/069501 on Aug. 26, 2015, now Pat. No. 10,596,608.

(30) Foreign Application Priority Data

Sep. 17, 2014 (EP) ..... 14185055

(51) Int. Cl.
*B21B 37/22* (2006.01)
*B21B 37/50* (2006.01)
(Continued)

(52) U.S. Cl.
CPC ..... *B21B 37/22* (2013.01); *B21B 37/50* (2013.01); *B21B 38/006* (2013.01); *B21B 38/04* (2013.01);
(Continued)

(58) Field of Classification Search
CPC ..... B21B 37/16; B21B 37/22; B21B 37/48; B21B 37/50; B21B 37/74; B21B 38/04;
(Continued)

(56) References Cited

U.S. PATENT DOCUMENTS 8,255,074 B2 8/2012 Meissen
9,694,403 B2 7/2017 Eckerstorfer et al.
(Continued)

FOREIGN PATENT DOCUMENTS

CN 102869460 1/2013
DE 198 51 053 5/2000
(Continued)

OTHER PUBLICATIONS

Translation JP 62-156010 A, Nomura et al., Jul. 1987.*
(Continued)

*Primary Examiner* — Edward T Tolan
(74) *Attorney, Agent, or Firm* — Ostrolenk Faber LLP

(57) ABSTRACT

Before the rolling of a metal strip on a finishing train, the actual width and actual temperature of portions of the metal strip are respectively detected. The portions of the metal strip are tracked while they run through the finishing train. The rolling stands are respectively assigned width controlling devices which determine the setpoint width and the actual width after the rolling in the assigned rolling stand, and a downstream additional setpoint value, by which the desired tension downstream of the assigned rolling stand is corrected in order to bring the actual width closer to the setpoint width. The downstream additional setpoint value is both taken into account in the determination of the actual width and fed to a tension controller, which sets an actual tension, in the metal strip downstream of the assigned rolling stand, in accordance with the corrected setpoint tension. Determining the downstream additional setpoint value by the difference between the setpoint width and the actual width of a portion of the metal strip.

14 Claims, 4 Drawing Sheets

(51) Int. Cl.

| | |
|---|---|
| ***B21B 38/00*** | (2006.01) |
| ***B21B 38/04*** | (2006.01) |
| *B21B 37/48* | (2006.01) |

(52) U.S. Cl.
CPC ..... *B21B 37/48* (2013.01); *B21B 2261/06* (2013.01); *B21B 2261/20* (2013.01); *B21B 2265/06* (2013.01); *B21B 2273/20* (2013.01)

(58) Field of Classification Search
CPC . B21B 38/06; B21B 2261/06; B21B 2261/20; B21B 2265/02; B21B 2265/06; B21B 2273/20
See application file for complete search history.

(56) References Cited

U.S. PATENT DOCUMENTS

| | | | |
|---|---|---|---|
| 2006/0117549 | A1 | 6/2006 | Plocoennik et al. |
| 2007/0006625 | A1 | 1/2007 | Reinschke |
| 2010/0192660 | A1 | 8/2010 | Kurz |
| 2015/0231679 | A1 | 8/2015 | Kurz |

FOREIGN PATENT DOCUMENTS

| | | | | | |
|---|---|---|---|---|---|
| DE | 103 38 470 | | | 9/2007 | |
| EP | 0 375 095 | | | 1/1996 | |
| JP | 57-160508 | A | * | 10/1982 | ..... B21B 37/78 |
| JP | S61-52917 | | | 3/1986 | |
| JP | 62-156010 | A | * | 7/1987 | ..... B21B 37/22 |
| JP | 62-289309 | A | * | 12/1987 | ..... B21B 37/02 |
| JP | H04-84612 | | | 3/1992 | |
| JP | H04-100620 | | | 4/1992 | |
| RU | 2 336 339 | | | 10/2008 | |
| SU | 1271902 | | | 11/1986 | |

OTHER PUBLICATIONS

Translation JP 62-289309 A, Kitano et al. Dec. 1987.*
International Search Report dated Nov. 11, 2015 in corresponding PCT International Application No. PCT/EP2015/069501.
Written Opinion dated Nov. 11, 2015 in corresponding PCT International Application No. PCT/EP2015/069501.
International Preliminary Report on Patentability dated Aug. 12, 2016 in corresponding PCT International Application No. PCT/EP2015/069501.
European Search Report dated Mar. 17, 2015 in corresponding European Patent Application No. 14185055.2.
M. Nakayama et al., "Development of Automatic Width Control System for Hot Strip Finishing Mills," Advanced Technology of Plasticity 1990, Proceedings of the Third International Conference on Technology of Plasticity, Kyoto, July 1/6, 1990; vol. II, pp. 791-796.
H. Natusch et al., "Automatische Breitenregelung in der Warmbandstraße Borlänge der SSAB Tunnplåt," stahl und eisen 122 (2002), No. 11, pp. 93-100, (see substitute specification, from p. 3, line 24, to p. 4, line 10, for statement of relevance).
Y. Hoshi et al., "Automatic width control system using interstand tension in hot strip finishing mill," La Revue de Métallurgie—CIT, Nov. 1996, pp. 1413-1420.
A. Ishii et al., "Strip width variation behavior and its mathematical model in hot strip finishing mills,"Proceedings of the 7th International Conference on Steel Rolling 1998, Chiba, Japan, The Iron and Steel Institute of Japan, pp. 93-98.
C.J. Park et al., "Direct Width Control Systems Based on Width Prediction Models in Hot Strip Mill," ISIJ International, vol. 47 (2007), No. 1, pp. 105-113.
Office Action dated Feb. 24, 2018 issued in corresponding Chinese Patent Application No. 201580050335.7 with English language translation.
Office Action dated Oct. 24, 2018 issued in corresponding Russian Patent Application No. 2017103303/02(005726) without English language translation.

* cited by examiner

WIDTH SETTING ON A FINISHING TRAIN

CROSS-REFERENCE TO RELATED APPLICATIONS

The present application is a divisional under 37 C.F.R. § 1.53(b) of prior U.S. patent application Ser. No. 15/511,693, filed Mar. 16, 2017, which is a 35 U.S.C. § 371 national phase conversion of PCT/EP2015/069501, filed Aug. 26, 2015, which claims priority of European Patent Application No. 14185055.2, filed Sep. 17, 2014. The entire content of each of these applications is incorporated in full by reference herein. The PCT International Application was published in the German language.

TECHNICAL FIELD

The present invention is directed to a method for rolling a metal strip in a finishing train, wherein the finishing train has multiple rolling stands, through which the metal strip passes in succession, and wherein the actual width and the actual temperature thereof is detected for each of the sections of the metal strip before they enter the finishing train.

The present invention is furthermore directed to a computer program, which comprises machine code, which is executable by a control unit for a finishing train, wherein the execution of the machine code by the control unit causes the machine unit to operate the finishing train according to such a method.

The present invention is furthermore directed to a control unit for a finishing train, wherein the control unit is programmed using such a computer program, so that the control unit operates the finishing train according to such a method.

The present invention is furthermore directed to a finishing train for rolling a metal strip, wherein the finishing train has multiple rolling stands through which the metal strip passes in succession, and wherein the finishing train has such a control unit, which operates the finishing train according to such a method.

TECHNICAL BACKGROUND

A hot rolling train for rolling metal strip generally consists of a roughing train, a finishing train, and a coiling device. The metal strip firstly passes through the roughing train and then the finishing train and is finally supplied to the coiling device. In many cases generally at least in hot strip trains for rolling steel strip, furthermore a cooling line is provided. If it is provided, the cooling line is arranged downstream of the finishing train and upstream of the coiling device.

Narrow width tolerances are often specified for the rolling of the metal strip. Maintaining these width tolerances is an important quality feature. Actively influencing the width of the metal strip therefore generates an economic utility.

The width of the metal strip is influenced both in the roughing train and also in the finishing train and also on the way to the coiling device. In some cases, this influencing is actively performed.

Thus, for example, a method is known from the technical article "Development of Automatic Width Control System for Hot Strip Finishing Mills" by M. Nakayama et al., Proceedings of the Third International Conference on Technology of Plasticity, Kyoto, Jul. 1/6, 1990, vol. II, pages 791 to 796, in which a width measurement is performed after multiple (but not all) rolling stands of the finishing train. Using all provided width measurements, the missing width measured values are estimated by means of a model. A compensation for width deviations is performed by the calculation and switching on of an additional strip tension for each loop lifter controller.

Performing a pilot control for the width deviations is known from the technical article "Automatische Breitenregelung in der WarmbandstraJe Borlange der SSAB Tunnplat [automatic width regulation in the hot strip train Borlange of SSAB Tunnplat]" by Harald Natusch et al., stahl and eisen 122 (2002), issue 11, pages 93 to 100. The width in the finishing train is ascertained in a manner supported by a model. A measurement of the width is performed before and after the roughing train and after the finishing train.

Disclosed in "Automatische Breitenregelung in der WarmbandstraJe Borlange der SSAB Tunnplat" by Harald Natusch et al., is an integrated width control concept ("ein integriertes Breitenregelungskonzept", page 95, left col., last paragraph). This concept comprises (see FIG. 4) an edger E1, a measurement system, and sensors for monitoring the material position to derive the width of the rolled product along its length in the roughing mill (R1, R2), the finishing mill (F1-F6) and downstream of the finishing mill and furthermore algorithms and strategies for controlling the width of the rolled stock.

Essential measurement of the width is done at:

Entry width at Edger E1, width of transfer bar downstream of R2, measurement of final strip width downstream of F6. Measured width data are considered by a level 2 process control ("PSC"), page 96, paragraph "Messwertverarbeitung") of the roughing mill. The measured width data are assigned to specific positions of the rolled strip (rolled stock).

Detecting the width of the metal strip in each case after the second and after the last rolling stand of a finishing train is known from the technical article "Automatic width control system using interstand tension in hot strip finishing mill" by Y. Hoshi et al., La Revue de Metallurgie-CIT, November 1996, pages 1413 to 1420. The tension between the first and the second rolling stands is regulated by means of the former measurement. The tensions between the third and the last rolling stand are regulated by means of the latter measurement.

Detecting a variable which is characteristic for the mass flow between each two rolling stands and, building on the detected variable, setting the strip tension between the two rolling stands, in order to reduce a width change, is known from DE 103 38 470 B4.

A method for regulating the width in a rolling train having at least two rolling stands, through which the metal strip passes in succession, is known from DE 198 51 053 A1. In this method, the width is detected after the last rolling stand passes through. The tension between the two rolling stands is regulated to influence the width of the metal strip.

A method for regulating the strip width during the finish rolling of hot strip in a multi-stand rolling train is known from EP 0 375 095 B1. In this method, the strip width is measured before the next-to-last stand and after the last stand. A width regulation using pilot control is performed. The strip tension before the last rolling stand of the rolling train is used as the control variable.

A width model for a finishing train is known from the technical article "Strip width variation behavior and its mathematical model in hot strip finishing mills" by Atsushi Ishii et al., Proceedings of The 7th International Conference on Steel Rolling 1998, Chiba, Japan, pages 93 to 98. Width influences in the rolling gap, for example, a relative strip profile change, a roller bend, a compressed length, and the intake-side and outlet-side tension are taken into consideration. Furthermore, width influences in the region between two rolling stands are taken into consideration, for example, the temperature, the tension prevailing in the metal strip, the yield strength, the strip temperature, and the duration.

A simplified width model is derived building on a width model based on finite elements in the technical article "Direct Width Control Systems Based on Width Prediction Models in Hot Strip Mill" by Cheol Jae Park et al., ISIJ International, vol. 47 (2007), issue 1, pages 105 to 113. The simplified width model is supplemented using a neuronal network. It models the width in the finishing train as a function of the intake-side tension in the metal strip, the present width, the thickness reduction, the compressed length, and the dimensional change resistance.

The methods of the prior art already cause the actual width of the metal strip to approximate the target width. The methods often only function inadequately, however. In addition, in a hot strip train without coil box, the temperature distribution is often uneven viewed over the length of the metal strip, which in turn results in an uneven widening of the metal strip in the finishing train.

SUMMARY OF THE INVENTION

The object of the present invention is to provide possibilities, by means of which the width of the metal strip can be set exactly in a simple and efficient manner.

According to the invention, a method is provided for rolling a metal strip in a finishing train which has multiple rolling stands through which the metal strip passes in succession.

The actual width and the actual temperature thereof are detected for each of the sections of the metal strip before they enter the finishing train.

An actual width derived from the detected actual width, an initial target width, an actual temperature derived from the detected actual temperature, and a target temperature are associated with each of the sections of the metal strip.

The sections of the metal strip are path-tracked during the passage through the finishing train.

A width control unit is associated at least with each of the rolling stands with the exception of the last rolling stand.

The respective width control unit for the section of the metal strip rolled in the associated rolling stand.

a) On the basis of all of its target width before the rolling in the associated rolling stand, a target tension desired in the metal strip before the associated rolling stand, a target tension desired in the metal strip after the associated rolling stand, the target temperature associated with the respective section and parameters of the rolling procedure performed in the associated rolling stand, ascertains a target width after the rolling in the associated rolling stand and associates it with the respective section of the metal strip.

b) On the basis of all of its actual width before the rolling in the associated rolling stand, the target tension, which is corrected by an upstream additional target value, desired in the metal strip before the associated rolling stand, the target tension, which is corrected by a downstream additional target value, desired in the metal strip after the associated rolling stand, the actual temperature associated with the respective section, and the parameters of the rolling procedure performed in the associated rolling stand, ascertains an actual width after the rolling in the associated rolling stand and associates it with the respective section of the metal strip. The respective width control unit ascertains the downstream additional target value on the basis of the target tension desired in the metal strip after the associated rolling stand, the target temperature and the actual temperature of the section of the metal strip rolled in the associated rolling stand, the difference of target width and actual width of a section of the metal strip which is located at a predetermined point after the associated rolling stand, and the parameters of the rolling procedure.

The respective width control unit ascertains the downstream additional target value such that the actual width of the section of the metal strip rolled in the associated rolling stand approximates the target width of the rolled section.

The respective width control unit supplies the downstream additional target value to a respective tension regulator, which sets an actual tension prevailing in the metal strip after the associated rolling stand corresponding to the target tension corrected by the downstream additional target value.

Only a single width measurement and a single temperature measurement are thus required, specifically between the roughening train and the finishing train. Width deviations can be compensated for highly accurately. If a width regulation is additionally also to be implemented, an additional width measurement after the finishing train is required for this purpose. Such a width measurement is typically provided, however, and therefore does not require additional hardware expenditure.

In the simplest case, the actual widths and actual temperatures associated with the sections are identical to the detected actual widths and actual temperatures. However, preferably at least the detected actual widths, preferably also the detected actual temperatures are filtered, in particular low-pass filtered. By way of this procedure, the rolling of the metal strip can be performed relatively calmly (i.e., without high-frequency control interventions) in particular. The manipulation of the actual width via the strip tension thus has no negative effects on the rolling process.

The filtering can be in particular such that no phase offset is induced by the filtering in the filtered variable (actual width or actual temperature) in relation to the unfiltered variable. Thus, filterings are to be performed in zero-phase filters. For this purpose, it is possible to provide a corresponding symmetrical filter, for example. Alternatively, it is possible that the detected actual widths are subjected to a first filtering and thus preliminarily filtered actual widths are ascertained and then the preliminarily filtered actual widths are subjected to a second filtering and the filtered actual widths are thus ascertained. Alternatively, the detected actual widths can be subjected in parallel to both the first filtering and also the second filtering and the mean value of the two filterings can be used as the filtered actual width. In both cases, the two filterings can have phasing. It is only required that the two filterings have inverse phasing in relation to one another, so that the phase offset caused by one filtering can be compensated for or balanced out by the other filtering. Similar procedures are possible if necessary with respect to the actual temperatures.

It is possible that the initial target width is predefined. Alternatively, the initial target width can be ascertained on the basis of the actual width associated with the sections.

It is possible that the predetermined point is permanently specified. Alternatively, it is possible that the predetermined point is specified to the width control units (optionally individually for each width control unit). For example, the middle between the associated rolling stand and the rolling stand directly downstream can be specified as the predetermined point for the respective width control unit. It is also optionally possible to provide the location at which a loop lifter engages on the metal strip as the predetermined point.

A point in time at which the metal strip enters this rolling stand is preferably detected at least for the rolling stand of the finishing train through which the metal strip passes first. In this case, the path tracking can be adapted on the basis of this point in time, i.e., in particular started in a timely manner.

It is alternatively possible to detect the actual width at the outlet of the roughening train or at the inlet of the finishing train. It is also alternatively possible to detect the actual temperature at the outlet of the roughening train or at the inlet of the finishing train. It is furthermore alternatively possible to firstly detect the respective actual width and the respective actual temperature for the entire metal strip (i.e., for all sections of the metal strip) and only then to perform the low-pass filterings. Alternatively, it is possible to perform the low-pass filterings simultaneously with the detection of the actual width and the actual temperature. Performing the low-pass filterings beforehand is advisable in particular if the actual width and the actual temperature are detected at the outlet of the roughening train. Performing the low-pass filterings together with the detection of the actual width and the actual temperature is advisable in particular if the actual width and actual temperature are detected at the inlet of the finishing train. Depending on how much time passes between the low-pass filterings and the entries of the sections of the metal strip into the first rolling stand of the finishing train, it can be necessary to progress the time development of the temperature of the sections by means of a temperature model.

The number of rolling stands of the finishing train can be determined as needed. In general, the number of rolling stands is 3 to 8, usually 4 to 7, in particular 5 or 6.

In particular steel, aluminum, and copper come into consideration as the metal. However, it is also possible that the metal strip consists of another metal.

In the scope of the present invention, it is necessary at various points to know the velocity of the metal strip. For this purpose, it is possible to perform a corresponding velocity measurement directly. Alternatively, it is possible to ascertain the respective velocity in that, in relation to the point for which the velocity of the metal strip is to be detected, the circumferential velocity of rollers of an upstream rolling stand is detected and the velocity of the metal strip is ascertained therefrom in consideration of the lead. In a similar manner, it is possible, vice versa, to ascertain the respective velocity in that the circumferential velocity of rollers of a downstream rolling stand is detected and the velocity of the metal strip is ascertained therefrom in consideration of the lag.

In many cases, a final rolling temperature is specified, which the metal strip is to have at the outlet of the finishing train. In this case, the final rolling temperature is preferably used as the target temperature. The actual temperature of the sections of the metal strip, in contrast, is preferably continuously tracked in a model-supported manner during the passage of the sections of the metal strip through the finishing train.

The parameters of the rolling procedure can be determined as needed. In general, the rolling force, the rolling torque, the strip velocity on the inlet side and/or outlet side of the associated rolling stand, the rolling gap, the pass reduction, the compressed length of the metal strip, and material variables of the metal strip can be used as parameters of the rolling procedure, with respect to the associated rolling stand.

In the simplest case, in the scope of the method according to the invention, only the widening during rolling in the rolling stands themselves is taken into consideration. However, it is preferably provided that the respective width control unit for the sections of the metal strip already rolled in the associated rolling stand tracks the target width after the rolling as a function of the spacing from the downstream rolling stand, the strip velocity on the outlet side of the associated rolling stand, the target tension desired in the metal strip after the associated rolling stand, the target temperature, and material characteristic variables of the metal strip and also tracks the actual width after the rolling as a function of the spacing from the downstream rolling stand, the strip velocity on the outlet side of the associated rolling stand, the target tension desired in the metal strip after the associated rolling stand, which is corrected by the downstream additional target value, the actual temperature, and the material characteristic variables of the metal strip.

The creeping of the width between the rolling stands can also be taken into consideration by this procedure.

The object is furthermore achieved by a computer program such that the execution of the machine code by the control unit causes the control unit to operate the finishing train according to a method according to the invention.

The object is furthermore achieved by a control unit for a finishing train, wherein the finishing train is programmed using a computer program according to the invention, so that the control unit operates the finishing train according to a method according to the invention.

The object is furthermore achieved by a finishing train for rolling a metal strip. The control unit of the finishing train is designed to operate the finishing train according to a method according to the invention.

The above-described properties, features, and advantages of this invention and the manner in which they are achieved will become clearer and more comprehensible in conjunction with the following description of the exemplary embodiments, which are explained in greater detail in conjunction with the drawings. In the schematic figures:

DESCRIPTION OF EMBODIMENTS

Figure 1:
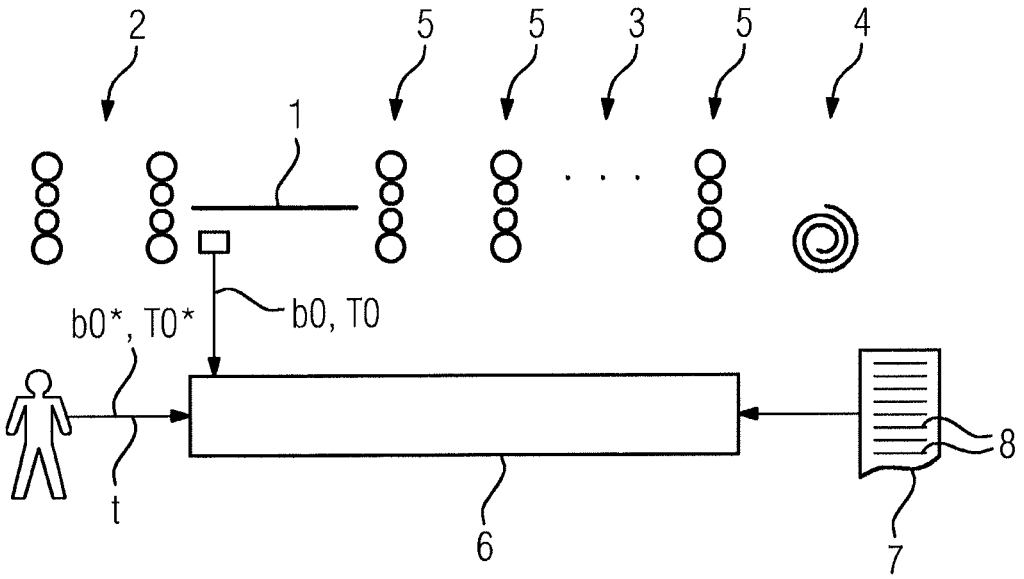
FIG. 1 shows a hot strip train.

According to FIG. 1, a hot strip train for rolling a metal strip 1 has a roughening train 2, a finishing train 3, and a coiling device 4. The roughening train 2 can be omitted in individual cases—for example, in the case in which the metal strip 1 is already cast relatively thin. The finishing train 3 has, according to FIG. 1, multiple rolling stands 5, through which the metal strip 1 passes in succession. The number of rolling stands 5 is generally between three and eight, in particular between four and seven, for example, five or six. The metal strip 1 can be, for example, a steel strip, an aluminum strip, a copper strip, or a strip made of another metal.

Figure 2:
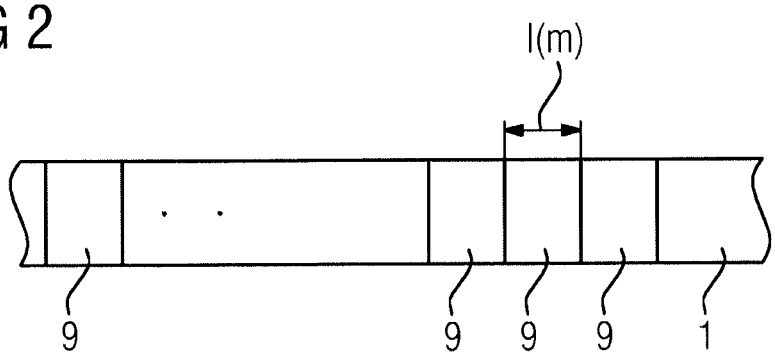
FIG. 2 shows sections of a metal strip.

The hot strip train—in particular the finishing train 3—is controlled by a control unit 6. The control unit 6 is programmed using a computer program 7. The computer program 7 comprises machine code 8, which is executable by the control unit 6. The execution of the machine code 8 by the control unit 6 causes the control unit 6 to operate the finishing train 3 according to a method which will be explained in greater detail hereafter in conjunction with FIG. 2 and the further figures. As a result of the programming using the computer program 7, the control unit 6 thus operates the finishing train 3 accordingly.

The metal strip 1 is virtually divided into sections 9 inside control unit 6. The sections 9 can be defined, for example, according to FIG. 2 by a uniform length 1, by a uniform mass m, or by a detection at chronologically equidistant steps.

Figure 3:
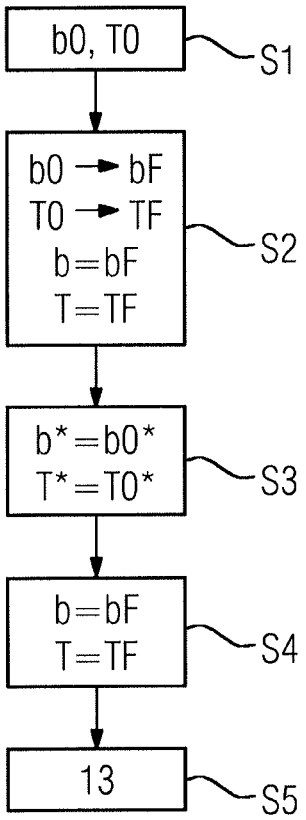
FIG. 3 shows a flow chart.

According to FIG. 3, in a step S1, the actual width b0 and the actual temperature T0 thereof is detected for each of the sections 9 of the metal strip 1. The detection of the actual width b0 and the actual temperature T0 is performed before the entry of the corresponding sections 9 into the finishing train 3. For example, according to FIG. 1, corresponding measurement units can be arranged at the outlet of the roughening train 2. Alternatively, the measuring units can be arranged at the inlet of the finishing train 3. It is possible that the detection of the actual widths b0 and the actual temperatures T0 is completed for all sections 9 even before the frontmost section 9 of the metal strip 1 enters the finishing train 3. Alternatively, it is possible that the detection of the actual widths b0 and actual temperatures T0 is still carried out for rear sections 9 of the metal strip 1 while front sections 9 of the metal strip 1 have already entered the finishing train 3. Independently of the specific procedure used, the detection is performed, however, such that the association of an actual width b and an actual temperature T subsequently performed in a step S2 is completed for each section 9 before the corresponding section 9 enters the finishing train 3.

Figure 4:
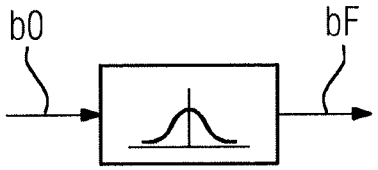
FIGS. 4 to 6 show filterings.

In the simplest case, in step S2, the detected actual widths b0 and actual temperatures T0 are associated directly with the sections 9. However, at least the detected actual widths b0, and preferably also the detected actual temperatures T0, are preferably filtered. In particular, low-pass filtering can be performed according to the illustration in FIGS. 4 to 6. In the case of a filtering, in step S2, a respective filtered actual width bF and a respective filtered actual temperature TF is ascertained for each section 9.

The filtering of step S2 is preferably performed such that the filtered actual widths bF do not have a phase offset in relation to the original, unfiltered actual widths b0 (zero-phase filtering). For example, for this purpose, according to FIG. 4, a filtering can be performed using a Gaussian bell curve (or another, symmetrical bell curve). Alternatively, one of the two following procedures is used.

Figure 5:
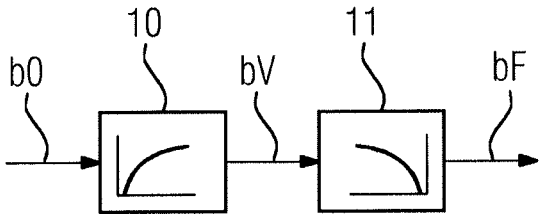

On the one hand, it is possible according to the illustration in FIG. 5 that the detected actual widths b0 are firstly subjected to a first filtering in a first filter block 10. Preliminarily filtered actual widths bV are thus ascertained. The preliminarily filtered actual widths bV are then subjected to a second filtering in a downstream second filter block 11. The results of the second filtering are the filtered actual widths bF. In this case, both the first filtering in the first filter block 10 and also the second filtering in the second filter block 11 can be subject to phasing. It is decisive in this case that the two filterings in the two filter blocks 10, 11 are subject to inverse phasing in relation to one another. The second filtering in the second filter block 11 therefore compensates the phase offset which was caused by the first filtering in the first filter block 10.

Figure 6:
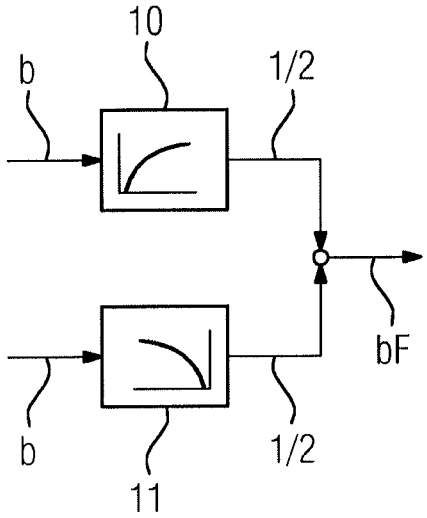

Alternatively, it is possible according to the illustration in FIG. 6 to carry out the two filterings in the two filter blocks 10, 11 in parallel. In this case, the detected actual widths b0 are thus subjected to both the first filtering and also the second filtering. The results of the two filterings are supplied in this case to a node point, in which the mean value of the two filterings is calculated. The mean value corresponds in this case to the filtered actual width bF.

Similar procedures can be used for the ascertainment of the filtered actual temperatures TF. In general, the same type of filtering is used for the ascertainment of the filtered actual temperatures TF as for the ascertainment of the filtered actual widths bF. However, this is not absolutely required. A zero-phase filtering is preferably also to be performed with respect to the actual temperatures T0.

In the case of a filtering, the filtered actual width bF ascertained for the respective section 9 of the metal strip 1 and the filtered actual temperature TF ascertained for the respective section 9 of the metal strip 1 are thus associated with the respective section 9 as the (new) actual width b or (new) actual temperature T, respectively. Furthermore, an initial target width b0* is associated with the respective section 9 as the target width b* and an initial target temperature T0* is associated as the target temperature 1* in a step S3.

It is possible that the initial target width b0* is externally specified to the control unit 6, for example, by a higher-order control unit (not shown) or by an operator 12. Alternatively, it is possible that the control unit 6 ascertains the initial target width b0* on the basis of the actual width b associated with the sections 9. For example, the control unit 6 can perform a mean value calculation over all sections 9 of the metal strip 1. In general, a final rolling temperature is specified to the control unit 6, i.e., the temperature which the metal strip 1 is to have upon exiting from the finishing train 3. It is possible that this temperature is used as the initial target temperature T0* or the initial target temperature T0* is ascertained on the basis of the final rolling temperature.

The control unit 6 implements a path tracking for the sections 9 of the metal strip 1 on the basis of the execution of the computer program 7 in a step S4. It is therefore known to the control unit 6 at every point in time which section 9 of the metal strip 1 is located at which point of the finishing train 3. The implementation of a path tracking is generally known to a person skilled in the art and therefore does not have to be explained in greater detail.

For the correct path tracking of the sections 9 of the metal strip 1, it is often necessary to detect a point in time t1 at which the metal strip 1 more precisely: the frontmost section 9 of the metal strip 1 enters the rolling stand 5 through which the metal strip 1 passes first. The point in time t1 can be detected, for example, in that the rolling force of this rolling stand 5 suddenly increases. In a similar manner, corresponding points in time t2, t3, etc. can also be detected for the other rolling stands 5 of the finishing train 3. The path tracking can be adapted in this manner on the basis of the detected points in time t1, t2, etc.

The control unit 6 furthermore implements a width control unit at least for each of the rolling stands 5 with the exception of the last rolling stand 5 of the finishing train 3 on the basis of the execution of the computer program 7 in a step S5. The respective width control unit 13 is associated with the respective rolling stand 5. It is possible that such a width control unit 13 is also provided for the last rolling stand 5 of the finishing train 3. However, this is not absolutely required. The construction and the functionality of one of the width control units 13 will be explained hereafter in conjunction with FIG. 7B as a representative for all width control units 13. Similar statements apply for the other width control units 13.

Figure 7A:
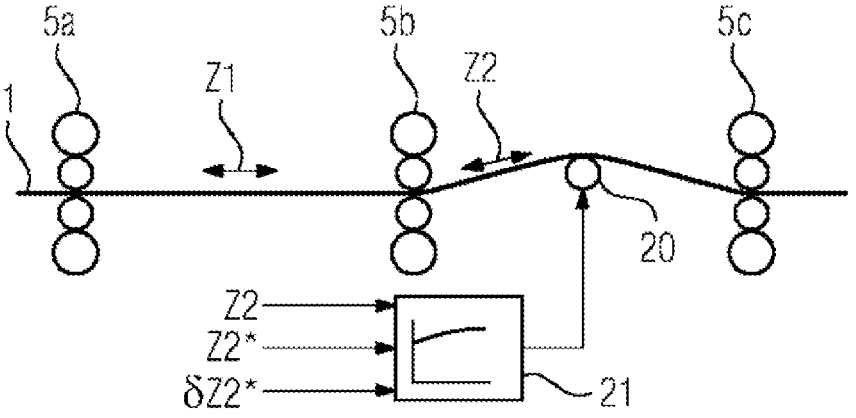
FIG. 7A shows a section of a finishing train.

The width control unit 13 is associated with a specific rolling stand 5. In the illustration of FIG. 7A, this is the middle rolling stand 5, referred to hereafter as the associated rolling stand and provided with reference sign 5*b*. The rolling stand 5 upstream from the associated rolling stand 5*b* is provided hereafter with the reference sign 5*a*. In a similar manner, the rolling stand 5 downstream from the associated rolling stand 5*b* is provided hereafter with the reference sign 5*c*.

Figure 7B:
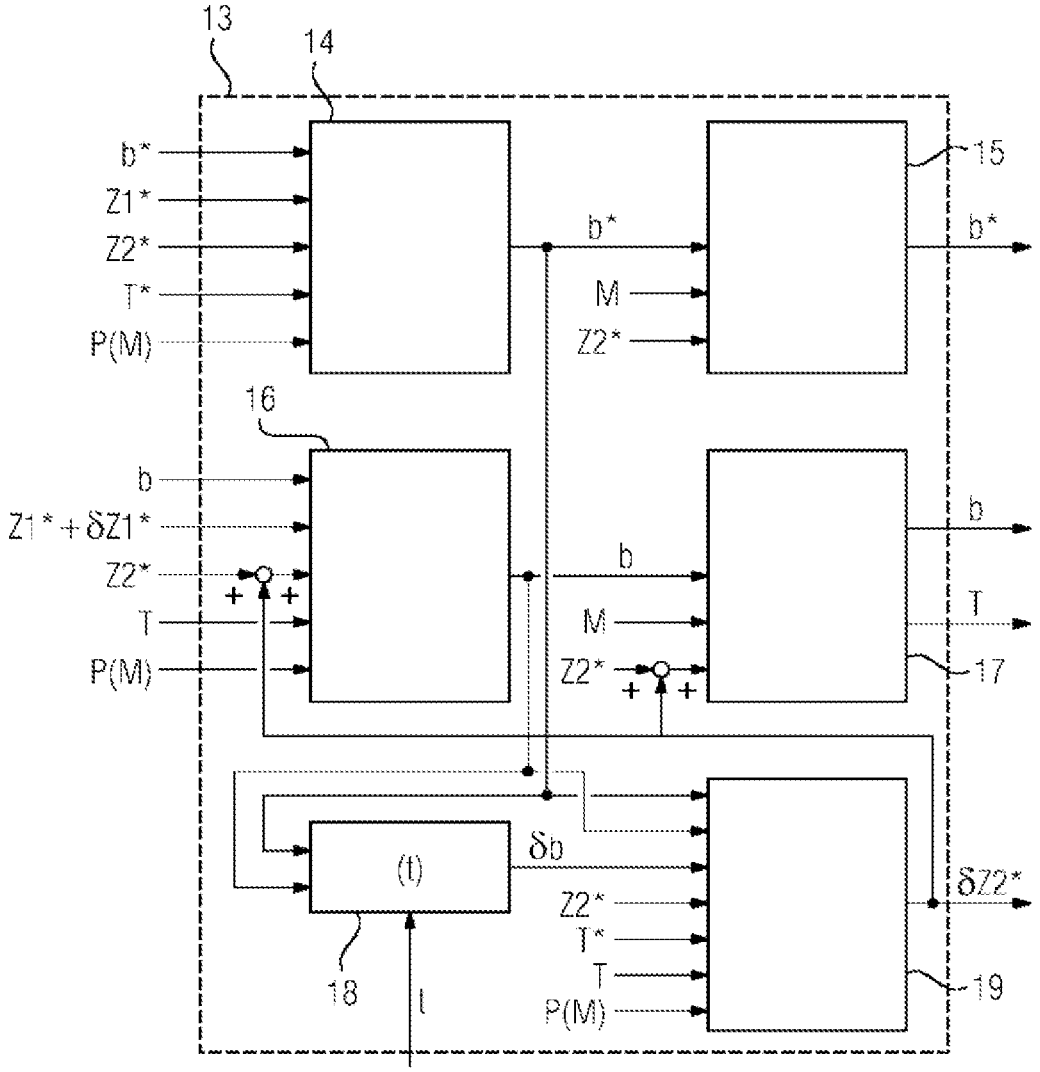
FIG. 7B shows a width control unit for a metal strip.

The width control unit 13 of FIG. 7B has at least function blocks 14 to 19.

The following variables are supplied to the function block 14:

- The target width b*, which is associated with the section 9 of the metal strip 1 presently being rolled in the associated rolling stand 5*b* before the rolling in the associated rolling stand 5*b*. In the case of the width control unit 13 associated with the first rolling stand 5 of the finishing train 3, the target width b* corresponds to the initial target width b*. In the case of the other width control units 13, the target width b* is provided by the function block 15 of the width control unit 13 associated with the upstream rolling stand 5*a*.
- A target tension Z1* is to prevail in the metal strip 1 before the associated rolling stand 5*b*. The target tension Z1* is determined by a corresponding specification from the higher-order control unit. Additional control interventions of the operator 12 can be taken into consideration if necessary.
- A target tension Z2* is to prevail in the metal strip 1 after the associated rolling stand 5*b*. The target tension Z2* is determined by a corresponding specification from the higher-order control unit. Additional control interventions of the operator 12 can also be taken into consideration if necessary here.
- The target temperature T* is associated with the section 9 of the metal strip 1 presently being rolled in the associated rolling stand 5*a* before the rolling in the associated rolling stand 5*b*.
- Parameters P of the rolling procedure occur in the associated rolling stand 5*b*. For example, always in relation to the associated rolling stand 5*b*, the rolling force, the rolling torque, the strip velocity on the inlet side and/or outlet side of the associated rolling stand, the rolling gap, the pass reduction, the compressed length of metal strip 1, and possibly temperature-related material variables M of the metal strip 1 can be used as the parameters P of the rolling procedure. The material characteristic variables M can comprise, for example, the modulus of elasticity, the yield strength, the forming resistance, and the like.

On the basis of the variables applied to the function block 14, the function block 14 ascertains a target width after the rolling in the associated rolling stand 5*b*. The function block 14 associates the ascertained target width as the new target width b* with the corresponding section 9 of the metal strip 1. The function block 14 supplies the new target width b* to the function block 15. The function block 14 thus internally models, with respect to the target values b*, T* of the respective section 9 of the metal strip 1, the widening behavior thereof in the rolling gap of the associated rolling stand 5*b*. The function block 14 therefore internally comprises a model of the associated rolling stand 5*b* which is based on mathematical-physical equations, in particular algebraic and differential equations. Such models are known per se to those skilled in the art. See the two technical articles mentioned at the outset "Strip width variation behaviour and its mathematical model in hot strip finishing mills" by Atsushi Ishii et al. and "Direct Width Control Systems Based on Width Prediction Models in Hot Strip Mill" by Cheol Jae Park et al.

In the simplest case, the function block 15 is designed as a simple buffer memory in the manner of a shift register or the like, in which solely the transport of the sections 9 of the metal strip 1 (including the target variables b*, T* which are associated with the sections 9) to the downstream rolling stand 5*c* is modeled. However, the target tension Z2*, which is desired in the metal strip 1 after the associated rolling stand 5*b*, and the material characteristic variables M of the metal strip 1 are preferably supplied to the function block 15. In this case, the function block 15 implements, in addition to the simple transport of the sections 9 of the metal strip 1, the creeping behavior of the target width b* of the sections 9 of the metal strip 1 buffered in the function block 15. The function block 15 thus tracks, for the buffered sections 9, the respective target width b* after the rolling in the associated rolling stand 5*b* as a function of the target tension Z2*, which is desired in the metal strip 1 after the associated rolling stand 5*b*, the target temperature T*, and the material characteristic variables M of the metal strip 1. Furthermore, the spacing a in relation to the downstream rolling stand 5*c* (more precisely: the spacing a plus the strip reserve stored between the associated rolling stand 5*b* and the downstream rolling stand 5*c*) and the strip velocity v after the associated rolling stand 5*b* are implicitly incorporated into the ascertainment of the function block 15. This is because these two variables a, v determine the transport time for which the sections 9 of the metal strip 1 are located in the inter-stand region between the associated rolling stand 5*b* and the downstream rolling stand 5*c*. The function block 15 provides, at the point in time of the rolling of a respective section 9 of the metal strip 1 in the downstream rolling stand 5*c*, the target width b* before the rolling in the downstream rolling stand 5*c* to the width control unit 13 associated with the downstream rolling stand 5*c*.

The spacing is a fixed variable, which only has to be parameterized once. If the stored strip reserve is also to be taken into consideration, this is easily possible. This is because the stored strip reserve can be ascertained in a simple manner by the position of a loop lifter 20, which is arranged between the associated rolling stand 5*b* and the downstream rolling stand 5*c*. The strip velocity v can vary in operation. It is possible to measure the strip velocity v directly by means of a corresponding measuring unit. Alternatively, the circumferential velocity of rollers of the associated rolling stand 5*b* can be measured and the strip velocity v can be ascertained therefrom in conjunction with the known lead. Again alternatively, the circumferential velocity of rollers of the downstream rolling stand 5 can be measured and the strip velocity v can be ascertained therefrom in conjunction with the known lag. The procedure which is used is the choice of a person skilled in the art.

The function block 16 is structurally and functionally equivalent to the function block 14 with regard to the approach. However, the following input variables are changed:

- Instead of the target width b*, the actual width b of the section 9 of the metal strip 1 presently being rolled in the associated rolling stand 5*b* is used. In the case of the width control unit 13 associated with the first rolling stand 5 of the finishing train 3, the actual width b corresponds to the actual width b associated with the sections 9 in step S2 of FIG. 3. In the case of the other width control units 13, the actual width b is provided by the function block 17 of the width control unit 13 associated with the upstream rolling stand 5*a*.

Instead of the target tension Z1*, a target tension corrected by an upstream additional target value δZ1* is used. In the case of the width control unit 13 associated with the first rolling stand 5 of the finishing train 3, the upstream additional target value δZ1* has the value 0. In the case of the other width control units 13, the upstream additional target value δZ1* is provided by the function block 19 of the width control unit 13 associated with the upstream rolling stand 5.

Instead of the target tension Z2*, a target tension corrected by a downstream additional target value δZ2* is used. The downstream additional target value δZ2* is provided according to FIG. 7 by the function block 19 of the respective width control unit 13 of FIG. 7B.

Instead of the target temperature T*, the actual temperature T is used. In the case of the width control unit 13 associated with the first rolling stand 5 of the finishing train 3, the actual temperature T corresponds to the actual temperature T associated with the sections 9 in step S2 of FIG. 3. In the case of the other width control units 13, the actual temperature T is provided by the width control unit 13 associated with the upstream rolling stand 5*a*.

The remaining variables are identical to those of the function block 14.

On the basis of the variables supplied to the function block 16, the function block 16 ascertains an actual width after the rolling in the associated rolling stand 5*b*. The function block 16 associates the ascertained actual width as the new actual width b with the corresponding section 9 of the metal strip 1. The function block 16 supplies the new actual width b to the function block 17. The function block 16 thus internally models, with respect to the actual values b, T of the respective section 9 of the metal strip 1, the widening behavior thereof in the rolling gap of the associated rolling stand 5*b*.

The function block 17 is structurally and functionally equivalent to the function block 15 with regard to the approach. However, if the function block 17 similarly to the function block 15 implements not only the transport of the sections 9 of the metal strip 1 (including the actual variables b, T associated with the sections 9) to the downstream rolling stand 5*c*, but rather also the creeping behavior of the actual width b of the sections 9 of the metal strip 1 buffered in the function block 15, the target tension Z2* corrected by the downstream additional target value δZ2* and furthermore as also in the function block 15 the material characteristic variables M of the metal strip 1 are supplied to the function block 17. In this case, the function block 17 thus tracks the respective actual width b for the buffered sections 9 after the rolling in the associated rolling stand 5*b* as a function of the target tension Z2*, which is corrected by the downstream additional target value δZ2*, the actual temperature T, and the material characteristic variables M of the metal strip 1. The spacing a in relation to the downstream rolling stand 5*c* and the strip velocity v after the associated rolling stand 5*b* are implicitly also incorporated into the ascertainment of the function block 17, as previously in the function block 15.

Furthermore and a difference exists here from the function block 15 the function block 17 generally tracks the actual temperature T of the sections 9, which are stored in the function block 17, continuously in a model-supported manner. The corresponding models are known to a person skilled in the art from the two above-mentioned technical articles and also in other ways. As a result, the actual temperature T of the sections 9 is therefore continuously tracked in a model-supported manner during the passage of the sections 9 of the metal strip 1 through the finishing train 3.

The newly ascertained target width b* is supplied by the function block 14 and the newly ascertained actual width b is supplied by the function block 15 to the function block 18. The function block 15 calculates the difference δb between target width b* and actual width b. Furthermore, the function block 18 buffers the difference δb ascertained thereby. The buffering is determined such that the section 9 of the metal strip 1 to which the ascertained difference δb relates, is located at a predetermined point between the associated rolling stand 5*b* and the downstream rolling stand 5*c* at the point in time at which the difference δb is output by the function block 18.

The predetermined point can be established as needed. The predetermined point can be, for example, the location at which the loop lifter 20 downstream from the associated rolling stand 5*b* acts on the metal strip 1. Alternatively, it can be a location in the region of the middle between the associated rolling stand 5*b* and the downstream rolling stand 5*c*, in particular exactly at the middle. The predetermined point can preferably be specified to the respective width control unit 13, in particular by the operator 12 or by the above-mentioned higher-order control unit.

The function block 18 supplies the difference δb to the function block 19. Furthermore, the target tension Z2*, the target temperature T*, and the actual temperature T, as well as the parameters P of the rolling procedure occurring in the respective rolling stand 5, are supplied to the function block 19. Furthermore, the widths b*, b, which are output from the function blocks 14 and 16, are often supplied per se to the function block 19. The function block 19 ascertains the downstream additional target value δZ2* on the basis of the variables supplied thereto. The ascertainment is performed such that the actual width b of the section 9 of the metal strip 1 rolled in the associated rolling stand 5*b* approximates the target width b* of the rolled section 9. In particular, the ascertainment is preferably performed such that the approximation is optimized for the point in time at which the section 9, for which the downstream additional target value δZ2* is ascertained, runs out of the downstream rolling stand 5*c*.

It is possible that the ascertainment is performed such that the actual width b is equal to the target width b*, i.e., complete correction is performed. Alternatively, it is possible that only partial correction is performed. The procedure which is utilized in the individual case is the choice of the person skilled in the art. In particular, it is possible to perform complete or nearly complete correction for the upstream rolling stands 5 of the finishing train 3, so that no or only residual corrections still have to be performed in the downstream rolling stands 5 of the finishing train 3.

The function block 19 furthermore supplies the downstream additional target value δZ2* to a tension regulator 21. Furthermore, the target tension Z2* and an actual tension Z2, which prevails in the metal strip 1 after the associated rolling stand 5*b*, are supplied to the tension regulator 21. The tension regulator 21 sets the actual tension Z2, which prevails in the metal strip 1 after the associated rolling stand 5*b*, in accordance with the target tension Z2* corrected by the downstream additional target value δZ2*. For example, the tension regulator 21 can act for this purpose on the loop lifter 20 in accordance with the illustration in FIG. 7. Alternatively or additionally, the tension regulator 21 can act on the roller circumferential velocity of the associated rolling stand 5*b* and/or the downstream rolling stand 5*c*. Alternatively or additionally, the tension regulator 21 can act on the setting of the downstream rolling stand 5*c*.

In summary, the present invention therefore relates to the following substantive matter:

Before the rolling of a metal strip 1 in a finishing train 3, the actual width b0 and the actual temperature T0 thereof is detected in each case for sections 9 of the metal strip 1. Variables bF, TF, which are derived from the detected variables b0, T0, and the corresponding target variables b*, 1* are associated with the sections 9. The sections 9 of the metal strip 1 are tracked during the passage through the finishing train 3. A width control unit 13 is associated with each of the rolling stands 5. The width control units 13 ascertain, on the basis of various input variables, the target width b* and the actual width b after the rolling in the associated rolling stand 5*b*. The width control units 13 furthermore ascertain a downstream additional target value δZ2*, by which the target tension Z2* is to be corrected after the associated rolling stand 5*b*, to approximate the actual width b to the target width b*. The downstream additional target value δZ2* is both taken into consideration in the ascertainment of the actual width b and also supplied to a tension regulator 21, which sets an actual tension Z2, which prevails in the metal strip 1 after the associated rolling stand 5*b*, in accordance with the corrected target tension Z2*. For the ascertainment of the downstream additional target value δZ2*, inter alia, the difference δb of target width b* and actual width b of a section 9 of the metal strip 1 is used, which is located at a predetermined point after the associated rolling stand 5.

The present invention has many advantages. Thus, for example, in the scope of the present invention, no measurement of temperatures T and widths b is required within the finishing train 3. Such a detection is only required before the finishing train 3. These detections are typically provided. In addition, the width b can be detected at the outlet of the finishing train 3 for quality control, for adaptation of the process model used, and possibly for optional width regulation. However, this is not absolutely required. If a width regulation is also implemented in addition to the width control according to the invention, the width regulation corrects, as a function of the actual width b after the finishing train 3 and the target width b* at this point, at least the target widths b*, possibly also the actual widths b. The correction is performed for the individual rolling stands 5, with which a width control unit 13 is associated. The correction is performed such that the ascertained auxiliary target values δZ1*, δZ2* compensate for the width deviation at the outlet of the finishing train 3. The control interventions are allocated onto multiple rolling stands 5 within the finishing train 3. The compensation in the upstream rolling stands 5 preferably dominates in this case. Preferably, only residual deviations are compensated for in the downstream rolling stands 5.

Although the invention was illustrated and described in greater detail by the preferred exemplary embodiment, the invention is not thus restricted by the disclosed examples and other variations can be derived therefrom by a person skilled in the art, without leaving the scope of protection of the invention.

LIST OF REFERENCE SIGNS

1 metal strip
2 roughening train
3 finishing train
4 coiling device
5, 5*a* to 5*c* rolling stands
6 control unit
7 computer program
8 machine code
9 sections
10, 11 filter blocks
12 operator
13 width control units
14 to 19 function blocks
20 loop lifter
21 tension regulator
a spacing
b, b0 actual widths
b*, b0* target widths
bF filtered actual widths
bV preliminarily filtered actual widths
l length
m mass
M material characteristic variables of the metal strip
P parameters of the rolling procedure
S1 to S5 steps
t time span
t1, t2, . . . points in time
T, T0 actual temperatures
T*, T0* target temperatures
TF filtered actual temperatures
TV preliminarily filtered actual temperatures
v strip velocity
Z1, Z2 actual tensions
Z1*, Z2* target tensions
δb difference between target width and actual width
δZ1*, δZ2* auxiliary target values

What is claimed is:

1. A finishing train for rolling a metal strip comprising:

multiple rolling stands through which a metal strip passes in succession; and a control unit that virtually divides the metal strip into a plurality of sections and operates the finishing train, 1) to roll the metal strip in the finishing train;

2) to detect an actual width (b0) and an actual temperature (T0) of each of the sections of the metal strip before each section enters the finishing train;

3) to derive an actual width (b) from the detected actual width (b0) for each section of the metal strip;

4) to derive an actual temperature (T) from the detected actual temperature (T0) for each section of the metal strip;

5) to associate each derived actual width (b) with an initial target width (b0*);

6) to associate each derived actual temperature (T) with a target temperature (T*);

7) to path-track the sections of the metal strip during passage of the metal strip through the finishing train;

8) to associate a width control unit with each of the rolling stands, except the last rolling stand in the succession of the plurality of rolling stands;

9) to ascertain, with each width control unit that is associated with a rolling stand of the rolling stands, a target width (b*) of each section of the strip after said each section is rolled in the rolling stand associated with said each width control unit, and to associate the target width (b*) with said each section of the metal strip, the ascertaining being based on all of said initial target width (b0*) before the rolling in the rolling stand associated with said each width control unit, a target tension (Z1*) desired in the metal strip before a rolling in said rolling stand associated with said each width control unit, a target tension (Z2*) desired in the metal strip after the rolling stand associated with said each width control unit, the target temperature (T*) associated with said each section of the rolling strip and parameters (P) of the rolling procedure performed in the rolling stand associated with said each width control unit, said each target width (b*) ascertained by said each control unit after the rolling in the rolling stand associated with said each width control unit and associating the target width (b*) with said each section of the metal strip;

10) to ascertain, with said each width control unit, an actual width (b) for said each section of the metal strip after the rolling in the rolling stand associated with said each width control unit and to associate the actual width (b) with said each section of the metal strip on the basis of all of the actual width (b) of said each section of metal strip before the rolling in the rolling stand associated with said each width control unit, the target tension (Z1*) of the metal strip, which is corrected by an upstream additional target value (δZ1*), which is desired in the metal strip before the rolling stand associated with said each width control unit, correcting the target tension (Z2*) by a downstream additional target value (δZ2*), which is desired in the metal strip after said each rolling stand associated with said each width control unit, the actual temperature (T) associated with the section of the metal strip, and the parameters (P) of the rolling procedure performed in the rolling stand associated with said each width control unit;

11) to use said each width control unit to ascertain the downstream additional target value (δZ2*) on the basis of the target tension (Z2*) desired in the metal strip after the rolling stand associated with said each width control unit, the target temperature (T*) and the actual temperature (T) of said each section of the metal strip rolled in the rolling stand associated with said each width control unit, a difference (δb) between the target width (b*) and the actual width (b) of a section of the metal strip which is located at a predetermined point after the rolling stand associated with said each width control unit, and the parameters (P) of the rolling procedure;

12) to use said each width control unit to ascertain the downstream additional target value (δZ2*) such that the actual width (b) of the rolled section of the metal strip rolled in the rolling stand associated with said each width control unit approximates the target width (b*) of the rolled section; and 13) to use said each width control unit to supply the downstream additional target value (δZ2*) to an associated tension regulator, which sets an actual tension prevailing in the metal strip after the rolling stand associated with said each width control unit and the actual tension corresponds to the target tension (Z2*) corrected by the downstream additional target value (δZ2*).

2. The finishing train as claimed in claim 1, wherein the actual widths (b0) and the actual temperatures (T0) are detected by a low pass filter.

3. The finishing train as claimed in claim 2, wherein the low pass filter does not induce a phase offset in a filtered variable (bF, TF) in relation to an unfiltered variable (b0, T0).

4. The finishing train as claimed in claim 3, wherein the low pass filter is a symmetrical filter.

5. The finishing train as claimed in claim 1, wherein the control unit predefines or ascertains the initial target width (b*) on the basis of the actual width (bF) associated with the sections of the metal strip.

6. The finishing train as claimed in claim 1, wherein the control unit specifies the predetermined point.

7. The finishing train as claimed in claim 1, wherein at least for a first to be passed rolling stand of the finishing train through which the metal strip passes first, the control unit detects a point in time (t1), at which the metal strip enters the first to be passed rolling stand, and adapts the path-tracking on the basis of the detected point in time (t0).

8. The finishing train as claimed in claim 1, wherein the control unit specifies a final rolling temperature and uses the final rolling temperature as the target temperature (T*), or subjects the actual temperature (T) in a model-supported manner during the passage of the sections of the metal strip through the finishing train.

9. The finishing train as claimed in claim 1, wherein the control unit uses a rolling force, a rolling torque, a strip velocity (v) on an inlet side, or an outlet side, or the inlet side and the outlet side, of an associated rolling stand, a rolling gap, a pass reduction, a compressed length of the metal strip, and material variables (M) of the metal strip as parameters (P) of the rolling procedure, with respect to the rolling stand associated with said each width control unit.

10. The finishing train as claimed in claim 1, wherein the control unit tracks, with said each width control unit, the target width (b*) after the rolling as a function of spacing (a) from the downstream rolling stand, a strip velocity (v) after the rolling stand associated with said each width control unit, the desired target tension (Z2*) in the metal strip after the rolling stand associated with said each width control unit, the target temperature (T*), and material characteristic variables (M) of the metal strip; and tracks, with said each width control unit, an actual width (bF) after the rolling as a function of the spacing (a) from the downstream rolling stand, the strip velocity (v) after the rolling stand associated with said each width control unit, the desired target tension (Z2*) in the metal strip after the rolling stand associated with said each width control unit corrected by the downstream additional target value (δZ2*), the actual temperature (T), and the material characteristic variables (M) of the metal strip.

11. The finishing train according to claim 3, wherein the detected variables (b0, T0) are subjected to a first filtering to ascertain preliminarily filtered actual variables (bV, TV) and then the preliminarily filtered actual variables (bV, TV) are subjected to a second filtering to ascertain the filtered actual variables (bF, TF).

12. The finishing train according to claim 3, wherein the detected variables (b0, T0) are subjected to both a first filtering and also a second filtering and the mean values of the two filterings are used as the filtered actual variables (bF, TF); and wherein the first and second filterings have inverse phasing in relation to one another.

13. A finishing train for rolling a metal strip comprising: multiple rolling stands through which a metal strip passes in succession; and a control uni, which operates the finishing train, 1) to roll the metal strip in the finishing train, wherein the metal strip is comprised of a plurality of sections along the metal strip;

2) to detect an actual width (b0) and an actual temperature (T0) of each of the sections of the metal strip before each section enters the finishing train;

3) to derive an actual width (b) from the detected actual width (b0) for each section of the metal strip;

4) to derive an actual temperature (T) from the detected actual temperature (T0) for each section of the metal strip;

5) to associate each derived actual width (b) with an initial target width (b0*);

6) to associate each derived actual temperature (T) with a target temperature (T*);

7) to path-track the sections of the metal strip during passage of the metal strip through the finishing train;

8) to associate a width control unit with each of the rolling stands, except the last rolling stand in the succession of the plurality of rolling stands;

9) to ascertain, with each width control unit that is associated with a rolling stand of the rolling stands, a target width (b*) of each section of the strip after said each section is rolled in the rolling stand associated with said each width control unit, and to associate the target width (b*) with said each section of the metal strip, the ascertaining being based on all of said initial target width (b0*) before the rolling in the rolling stand associated with said each width control unit, a target tension (Z1*) desired in the metal strip before a rolling in said rolling stand associated with said each width control unit, a target tension (Z2*) desired in the metal strip after the rolling stand associated with said each width control unit, the target temperature (T*) associated with said each section of the rolling strip and parameters (P) of the rolling procedure performed in the rolling stand associated with said each width control unit, said each target width (b*) ascertained by said each control unit after the rolling in the rolling stand associated with said each width control unit and associating the target width (b*) with said each section of the metal strip;

10) to ascertain, with said each width control unit, an actual width (b) for said each section of the metal strip after the rolling in the rolling stand associated with said each width control unit and to associate the actual width (b) with said each section of the metal strip on the basis of all of the actual width (b) of said each section of metal strip before the rolling in the rolling stand associated with said each width control unit, the target tension (Z1*) of the metal strip, which is corrected by an upstream additional target value (δZ1*), which is desired in the metal strip before the rolling stand associated with said each width control unit, correcting the target tension (Z2*) by a downstream additional target value (δZ2*), which is desired in the metal strip after said each rolling stand associated with said each width control unit, the actual temperature (T) associated with the section of the metal strip, and the parameters (P) of the rolling procedure performed in the rolling stand associated with said each width control unit;

11) to use said each width control unit to ascertain the downstream additional target value (δZ2*) on the basis of the target tension (Z2*) desired in the metal strip after the rolling stand associated with said each width control unit, the target temperature (T*) and the actual temperature (T) of said each section of the metal strip rolled in the rolling stand associated with said each width control unit, a difference (δb) between the target width (b*) and the actual width (b) of a section of the metal strip which is located at a predetermined point after the rolling stand associated with said each width control unit, and the parameters (P) of the rolling procedure;

12) to use said each width control unit to ascertain the downstream additional target value (δZ2*) such that the actual width (b) of the rolled section of the metal strip rolled in the rolling stand associated with said each width control unit approximates the target width (b*) of the rolled section; and 13) to use said each width control unit to supply the downstream additional target value (δZ2*) to an associated tension regulator, which sets an actual tension prevailing in the metal strip after the rolling stand associated with said each width control unit and the actual tension corresponds to the target tension (Z2*) corrected by the downstream additional target value (δZ2*), wherein the control unit tracks, with said each width control unit, the target width (b*) after the rolling as a function of spacing (a) from the downstream rolling stand, a strip velocity (v) after the rolling stand associated with said each width control unit, the desired target tension (Z2*) in the metal strip after the rolling stand associated with said each width control unit, the target temperature (T*), and material characteristic variables (M) of the metal strip; and tracks, with said each width control unit, an actual width (bF) after the rolling as a function of the spacing (a) from the downstream rolling stand, the strip velocity (v) after the rolling stand associated with said each width control unit, the desired target tension (Z2*) in the metal strip after the rolling stand associated with said each width control unit corrected by the downstream additional target value (δZ2*), the actual temperature (T), and the material characteristic variables (M) of the metal strip.

14. A finishing train for rolling a metal strip comprising: multiple rolling stands through which a metal strip passes in succession; and a control unit, which operates the finishing train, 1) to roll the metal strip in the finishing train, wherein the metal strip is comprised of a plurality of sections along the metal strip;

2) to detect an actual width (b0) and an actual temperature (T0) of each of the sections of the metal strip before each section enters the finishing train;

3) to derive an actual width (b) from the detected actual width (b0) for each section of the metal strip;

4) to derive an actual temperature (T) from the detected actual temperature (T0) for each section of the metal strip;

5) to associate each derived actual width (b) with an initial target width (b0*);

6) to associate each derived actual temperature (T) with a target temperature (T*);

7) to path-track the sections of the metal strip during passage of the metal strip through the finishing train;

8) to associate a width control unit with each of the rolling stands, except the last rolling stand in the succession of the plurality of rolling stands;

9) to ascertain, with each width control unit that is associated with a rolling stand of the rolling stands, a target width (b*) of each section of the strip after said each section is rolled in the rolling stand associated with said each width control unit, and to associate the target width (b*) with said each section of the metal strip, the ascertaining being based on all of said initial target width (b0*) before the rolling in the rolling stand associated with said each width control unit, a target tension (Z1*) desired in the metal strip before a rolling in said rolling stand associated with said each width control unit, a target tension (Z2*) desired in the metal strip after the rolling stand associated with said each width control unit, the target temperature (T*) associated with said each section of the rolling strip and parameters (P) of the rolling procedure performed in the rolling stand associated with said each width control unit, said each target width (b*) ascertained by said each control unit after the rolling in the rolling stand associated with said each width control unit and associating the target width (b*) with said each section of the metal strip;

10) to ascertain, with said each width control unit, an actual width (b) for said each section of the metal strip after the rolling in the rolling stand associated with said each width control unit and to associate the actual width (b) with said each section of the metal strip on the basis of all of the actual width (b) of said each section of metal strip before the rolling in the rolling stand associated with said each width control unit, the target tension (Z1*) of the metal strip, which is corrected by an upstream additional target value (δZ2*), which is desired in the metal strip before the rolling stand associated with said each width control unit, correcting the target tension (Z2*) by a downstream additional target value (δZ2*), which is desired in the metal strip after said each rolling stand associated with said each width control unit, the actual temperature (T) associated with the section of the metal strip, and the parameters (P) of the rolling procedure performed in the rolling stand associated with said each width control unit;

11) to use said each width control unit to ascertain the downstream additional target value (δZ2*) on the basis of the target tension (Z2*) desired in the metal strip after the rolling stand associated with said each width control unit, the target temperature (T*) and the actual temperature (T) of said each section of the metal strip rolled in the rolling stand associated with said each width control unit, a difference (δb) between the target width (b*) and the actual width (b) of a section of the metal strip which is located at a predetermined point after the rolling stand associated with said each width control unit, and the parameters (P) of the rolling procedure;

12) to use said each width control unit to ascertain the downstream additional target value (δZ2*) such that the actual width (b) of the rolled section of the metal strip rolled in the rolling stand associated with said each width control unit approximates the target width (b*) of the rolled section; and 13) to use said each width control unit to supply the downstream additional target value (δZ2*) to an associated tension regulator, which sets an actual tension prevailing in the metal strip after the rolling stand associated with said each width control unit and the actual tension corresponds to the target tension (Z2*) corrected by the downstream additional target value (δZ2*), wherein the actual widths (b0) and the actual temperatures (T0) are detected by a low pass filter, wherein the low pass filter does not induce a phase offset in a filtered variable (bF, TF) in relation to an unfiltered variable (b0, T0), and wherein the detected variables (b0, T0) are subjected to a first filtering to ascertain preliminarily filtered actual variables (bV, TV) and then the preliminarily filtered actual variables (bV, TV) are subjected to a second filtering to ascertain the filtered actual variables (bF, TF), or the detected variables (b0, T0) are subjected to both a first filtering and also a second filtering and the mean values of the two filterings are used as the filtered actual variables (bF, TF); and wherein the first and second filterings have inverse phasing in relation to one another.

* * * * *